US007111662B2

(12) United States Patent
Lukos

(10) Patent No.: US 7,111,662 B2
(45) Date of Patent: Sep. 26, 2006

(54) ROLLER TUBE HAVING EXTERNAL SLOT FOR MOUNTING SCREEN MATERIAL

(76) Inventor: Stephen Lukos, 1879 Litchfield Rd., Watertown, CT (US) 06795

( * ) Notice: Subject to any disclaimer, the term of this patent is extended or adjusted under 35 U.S.C. 154(b) by 11 days.

(21) Appl. No.: 10/959,444

(22) Filed: Oct. 5, 2004

(65) Prior Publication Data

US 2006/0070708 A1 Apr. 6, 2006

(51) Int. Cl.
*A47H 13/00* (2006.01)

(52) U.S. Cl. ..... 160/392; 160/310

(58) Field of Classification Search ..... 160/392, 160/395, 383, 310, 405, 133, 23.1
See application file for complete search history.

(56) References Cited

U.S. PATENT DOCUMENTS

| | | | | | |
|---|---|---|---|---|---|
| 165,935 | A | | 7/1875 | Knapp | |
| 618,822 | A | | 2/1899 | Barr | |
| 618,828 | A | | 2/1899 | Barr | |
| 696,373 | A | | 3/1902 | Hutchison | |
| 898,983 | A | | 9/1908 | Melick | |
| 1,013,531 | A | * | 1/1912 | Carmany | 160/297 |
| 1,099,021 | A | | 6/1914 | Campbell | |
| 1,202,287 | A | * | 10/1916 | Hartshom | 160/392 |
| 1,450,520 | A | * | 4/1923 | Smith | 160/387 |
| 1,515,040 | A | | 11/1924 | Hartshorn | |
| 1,562,105 | A | * | 11/1925 | McDonald | 160/392 |
| 2,336,189 | A | | 12/1943 | Price | |
| 2,547,592 | A | * | 4/1951 | D Azzo | 160/45 |
| 3,329,195 | A | * | 7/1967 | Kochanowski | 160/24 |
| 3,724,524 | A | * | 4/1973 | Potter | 160/24 |
| 5,123,474 | A | * | 6/1992 | Smith | 160/310 |
| 5,384,941 | A | * | 1/1995 | Welser | 24/462 |
| 5,540,269 | A | * | 7/1996 | Plumer | 160/3 |
| 6,237,667 | B1 | | 5/2001 | Fraczek et al. | |
| 2005/0167058 | A1 | * | 8/2005 | Walker et al. | 160/395 |

OTHER PUBLICATIONS

Sweets Catalog, 12492/MAR, BuyLine 4895, Mariak Industries, Inc., pp. 1-3.
Mariak Industries, Inc., Product Cut Sheet: Chain Operated Clutch Roller Shade System, pp. 1-2, www.mariak.com.
Mariak Industries, Inc., Product Cut Sheet: Motorized Roller Shade System, pp. 1-2, www.mariak.com.

* cited by examiner

*Primary Examiner*—David Purol
(74) *Attorney, Agent, or Firm*—Lipsitz & McAllister, LLC

(57) ABSTRACT

A roller tube including a body having a tube wall that defines an interior and an exterior. The body includes a first end and a second end opposite the first end. A surface feature is formed in the tube wall proximate the exterior. The surface feature is configured to receive a sheet material and is configured to deformably fix the sheet material to the tube wall. The surface feature maintains a circular profile in the tube wall proximate the interior.

30 Claims, 4 Drawing Sheets

ROLLER TUBE HAVING EXTERNAL SLOT FOR MOUNTING SCREEN MATERIAL

BACKGROUND

The present invention relates to solar screens, awnings and the like, and more particularly, to a roller tube for a solar screen or similar material including an integral slot that maintains a circular inside diameter for mounting drive motors.

Roller shade systems make use of flexible shades supported by elongated roller tubes. The roller tube, typically made from aluminum or steel, is rotatably supported and provides support for the flexible shade on the roller tube. Roller shades include manual shades having spring driven roller tubes and motorized shades having drive motors engaging the roller tube to rotatingly drive the tube. The drive motors for motorized shades include externally mounted motors engaging an end of the roller tube and internal motors that are received within an interior defined by the tube.

Conventional roller shades have support systems that engage the opposite ends of the roller tube to provide the rotatable support that is required for winding and unwinding of the flexible shade. The support system includes a drive end support assembly having a coupler engaging the open end of the tube for rotation. The coupler is adapted to receive the drive shaft of a motor such that rotation of the drive shaft is transferred to the coupler for rotation of the tube. The motor is secured to a bracket for attachment of the roller shade system to the wall or ceiling of a structure, for example. A coupler engaging an opposite end of the roller tube could receive a motor drive shaft or, alternatively, could receive a rotatably supported shaft of an idler assembly.

In certain roller tube arrangements, the drive motor is inserted into the roller tube body. The drive motor includes a substantially circular outer shape that snuggly fits into the inside diameter of the cylinder shaped roller tube.

The roller tube serves to support and fix the screen material, such that the screen can wind and unwind in a smooth manner. It is important in the attachment of the screen to the roller tube outside diameter to align the screen perpendicular to the axis of rotation of the roller tube. If the screen is out-of-square alignment with the roller tube, then the screen will wind and unwind in an uneven manner. A screen that is out of alignment can bind and create unsightly wrinkles along the surface of the solar screen/awning that is undesirable.

The prior art roller tube designs have attempted to solve the problem of attachment of the screen to the roller tube in various ways. A common prior art technique of attachment is to use carpet tape along the outer surface of the roller tube. The carpet tape adheres to both the roller tube and the screen. The carpet tape technique can result in a time consuming process that can yield screens that are out of alignment.

Another prior art technique of attachment is to form a groove in the roller tube exterior for insertion of the screen material. The groove acts to align the roller tube material sufficiently. This technique may include a separate bar that can clamp onto and or into the groove in the roller tube such that the screen material is clamped between the bar and the groove.

A substantial drawback of the prior art roller tube and groove techniques is that the groove formed in the roller tube creates a protrusion that bulges into the inside diameter of the roller tube. The protrusion into the prior art roller tubes inhibits the insertion of a drive motor into the roller tube. With the protrusion, the roller tube cannot accept the substantially circular drive motor without modification to the drive motor housing. Modification of the drive motor makes the installation more costly and less practical.

Other prior art attempts maintaining the circular inside diameter involve the use of additional clamping bars to the exterior of the roller tube. These techniques lose the advantage of the groove to provide a true orthogonal baseline to align the screen material, and create a bump in the material rolled around the tube.

It would be advantageous to provide a method and an apparatus to ensure that roller tube and screen material are in proper orthogonal alignment while being able to utilize interior drive motors without the added costs and complexity of the prior art systems. The present invention provides the aforementioned and other advantages.

What is needed in the art is a roller tube having an external slot for mounting the screen without forming protrusions in the roller tube interior.

SUMMARY

In accordance with the present invention, a roller tube includes a body having a tube wall that defines an interior and an exterior. The body includes a first end and a second end opposite the first end. A surface feature is formed in the tube wall proximate the exterior. The surface feature is configured to receive a sheet material and is configured to deformably fix the sheet material to the tube wall. The surface feature maintains a circular profile in the tube wall proximate the interior.

In an exemplary embodiment, the surface feature can comprise a groove formed in the tube wall proximate the exterior. The surface feature can be malleable and can be configured to attach the material in a fixed position orthogonal to an axis of rotation of the body. The surface feature can extend between the first end and the second end. The surface feature can include a flange extending from a groove formed in the tube wall. The flange can be deformable and can be configured to substantially close over the groove to secure the sheet material to the tube wall exterior. The tube wall interior can be configured to receive a drive motor housing internally mounted in the tube wall interior. The drive motor can comprise a substantially circular housing exterior. The tube wall can include an interior having a substantially circular diameter and can be configured to receive the drive motor in the absence of modification to the drive motor exterior shape. The surface feature can be configured with the absence of protrusions at the tube wall interior. The surface feature can be configured for pressing against the sheet material at predetermined intervals along the tube wall for securing the sheet material to the roller tube.

An exemplary method is provided for securing a sheet material to a roller tube. The method can include forming a roller tube body from a tube wall defining an interior and an exterior. The tube body can include a first end and a second end. A surface feature can be formed in the tube wall proximate the exterior with the absence of protrusions in the interior of the tube wall. A sheet material can be inserted into the surface feature. The surface feature can be deformed, fixing the sheet material to the roller tube.

In an exemplary embodiment, the surface feature comprises a flange integrally formed from the tube wall which extends from the tube wall. The method includes the step of receiving a drive motor in the interior of the tube in the absence of modification to the drive motor housing. The surface feature can be pressed against the sheet material at predetermined intervals along the tube wall to secure the sheet material. The predetermined interval can include from about 3 inches to about 5 inches. The surface feature can comprise a groove and a flange formed by the tube wall. The flange can be made deformable over the groove and can be configured to fix the sheet material to the exterior of the roller tube. The method provides winding the sheet material around the roller tube at least one and a half revolutions to secure the sheet material to the roller tube. The interior of the tube body can be substantially circular in shape.

In another exemplary embodiment, a roller tube includes a body having a tube wall defining an interior and an exterior. The body can include a first end and a second end opposite the first end. A surface feature can be formed in the tube wall proximate the exterior. The surface feature can be configured to receive an attachment insert coupled to a sheet material and couple the sheet material to the tube wall. The surface feature can allow a circular profile to be maintained in the tube wall proximate the interior.

In an exemplary embodiment, the surface feature can include a groove formed in the tube wall proximate the exterior configured to receive the attachment insert. The attachment insert can be configured to attach the material in a fixed position orthogonal to an axis of rotation of the body. The surface feature can include at least one flange extending from a groove formed in the tube wall. The flange can be deformable and can be configured to substantially close over the groove to secure the attachment insert to the tube wall exterior. The surface feature can be configured for pressing against the attachment insert at predetermined intervals along the tube wall for securing the sheet material to the roller tube. The attachment insert can be coupled to the sheet material by one of welding or sewing.

BRIEF DESCRIPTION OF THE FIGURES

Referring now to the figures, wherein like elements are numbered alike.

DETAILED DESCRIPTION

The disclosure provides an exemplary roller tube for a solar screen, awning or the like. The roller tube can include a tube body formed by a tube wall. The tube wall defines an interior of the roller tube and an exterior of the roller tube. The roller tube body defines a length between a first end and a second end. A surface feature is formed in the tube wall at the exterior of the tube body. The surface feature is configured to receive a sheet material. The surface feature is malleable and can be deformed to clamp onto the sheet material such that the sheet material is bound in place on the exterior of the tube body. The surface feature does not create any protrusions into the interior of the tube body, such that the tube body has a circular profile in the interior. The roller tube can be configured to support a sheet material wound around the roller tube body along the length of the body between the first and second ends of the body. The sheet material can comprise a solar screen for an awning. Alternatively, the sheet material can comprise a window shade material, awning material, canvas, plastic sheeting, screening, or any other material adapted to be wound on a core.

Figure 1:
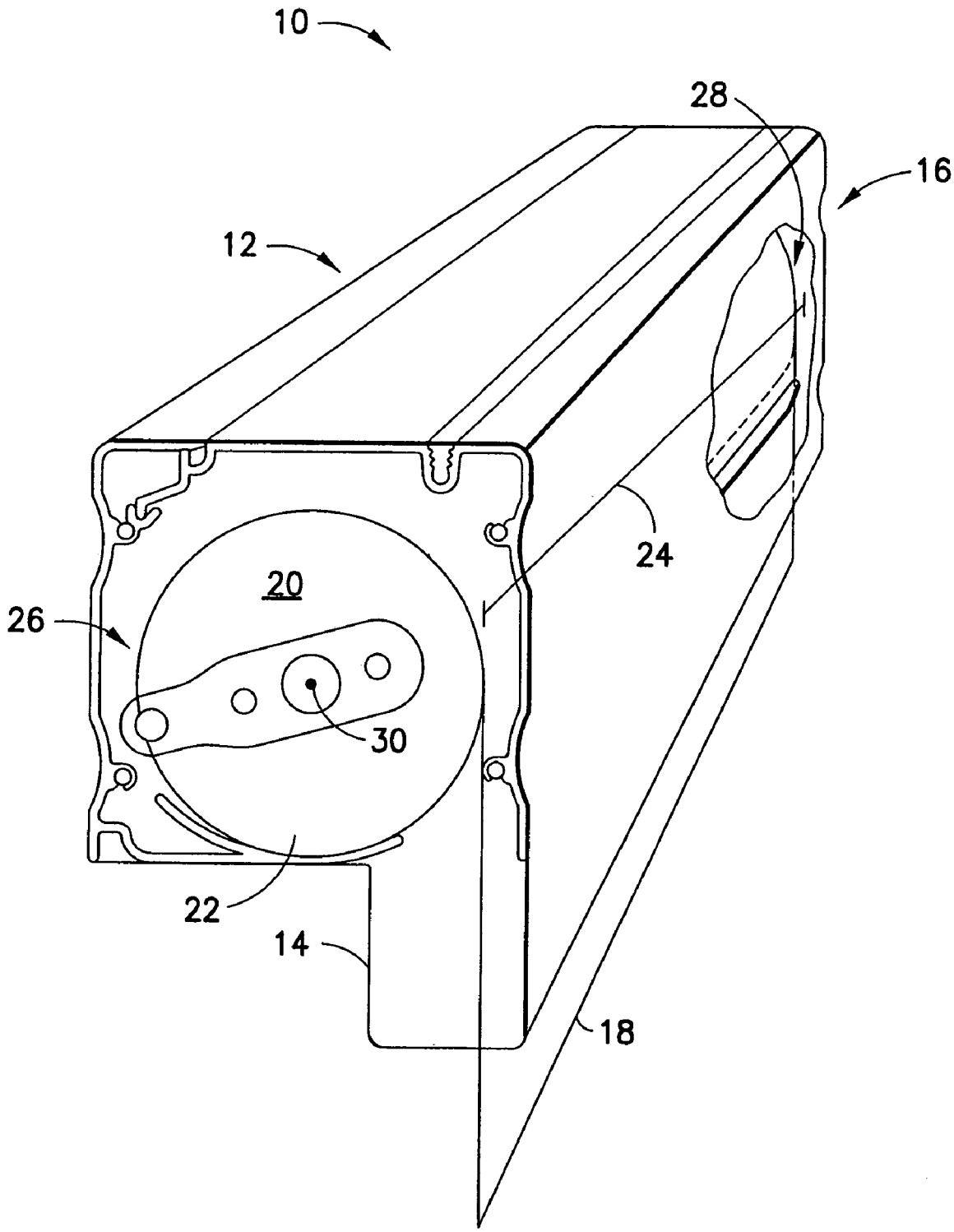
FIG. 1 is a perspective view of an exemplary support mechanism.

FIG. 1 illustrates an exemplary embodiment of the roller tube in a support mechanism 10. The support mechanism 10 includes a housing assembly 12 that extends laterally between a first mount 14 and a second mount 16 opposite the first mount 14. The housing assembly 12 can be mounted on a wall, ceiling, and the like, to provide a stable position to deploy a sheet material 18. The housing assembly 12 can be constructed of a rigid material through various means including, for example, extruded aluminum and the like.

A roller tube 20 is rotatably mounted in the housing assembly 12. The roller tube 20 can be pivotably supported on the first mount 14 and second mount 16. The roller tube 20 includes a body 22 that extends along a length 24 between a first end 26 and a second end 28. The roller tube body 22 can have a cylindrical shape including a circular cross-section extending along the length 24. The roller tube 20 is configured to support the sheet material 18, such as solar screen material. The sheet material 18 can be wound around the roller tube 20 about an axis of rotation (axis) 30 of the roller tube 20. As the sheet material 18 is wound (wrapped) around the roller tube body 22 the diameter of the roller tube 20 and sheet material 18 increases. As the sheet material is unwound, the diameter of the roller tube 20 and sheet material 18 decreases. The sheet material 18 is wound and unwound on the roller tube 20 such that the sheet material remains substantially orthogonal to the axis 30. By remaining in an orthogonal alignment, the sheet material is maintained in a wrinkle free manner. In an exemplary embodiment, the sheet material 18 can be wound around the roller tube 20 about one and a half times to secure the sheet material 18 to the roller tube 20.

Figure 2:
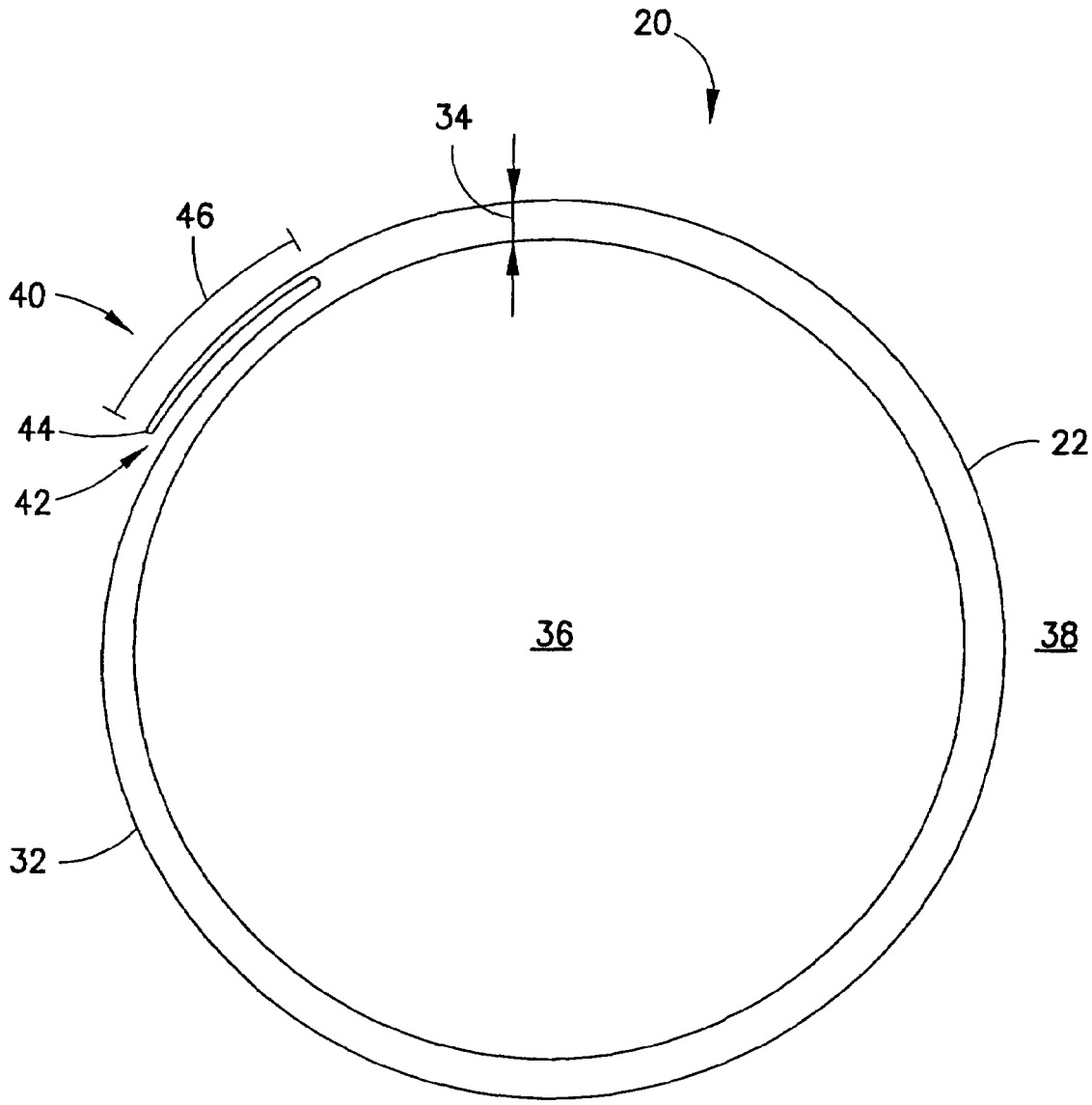
FIG. 2 is a side cross-section view of an exemplary roller tube.

FIG. 2 illustrates a cross-sectional side view of an exemplary roller tube 20. The roller tube body 22 can include a tube wall 32 having a thickness 34. The tube wall 32 defines an interior 36 and an exterior 38 of the tube body 22. The interior 36 of the tube body 22 can be hollow and substantially circular in shape, such that the inside diameter of the tube wall 32 has a circular cross-section. The roller tube 20 can be formed in substantially a cylindrical shape to receive a motor 50 therewithin. The exterior 38 can be substantially circular and configured to receive the sheet material 18 wrapped thereon in a roll about the roller tube 20, as shown in FIG. 1.

The roller tube wall 32 can include a surface feature 40 formed proximate the exterior 38. The surface feature 40 is configured to receive and fix the sheet material 18 about the exterior of the tube body 22. The surface feature 40 is malleable, such that the surface feature 40 can be deformed onto the sheet material to clamp onto and fix the sheet material 18 to the roller tube 20. The surface feature 40 does not change the shape of the interior 36. The surface feature 40 does not create any protrusions into the interior 36 such that the inside diameter of the tube wall 32 can be maintained substantially circular in cross-section/profile. The surface feature 40 is integrally formed from the tube wall 32 and can extend from the first end 26 to the second end 28. In an exemplary embodiment, the surface feature 40 can be formed with the tube wall 32, such as by extrusion.

In an exemplary embodiment, the surface feature 40 comprises a groove 42 formed in the tube wall 32 at the exterior 38 of the tube wall 32. The groove 42 can be formed into the thickness 34 of the tube wall 32. The groove 42 can be formed such that the sheet material 18 inserted into the groove 42 will align orthogonal to the axis of rotation 30. The depth of the groove 42 can be constant along the length 24 or can be varied. The depth of the groove 42 can be greater than the thickness 34 dimension. In an exemplary embodiment, the groove can be about 3/16 inch deep.

Figure 3:
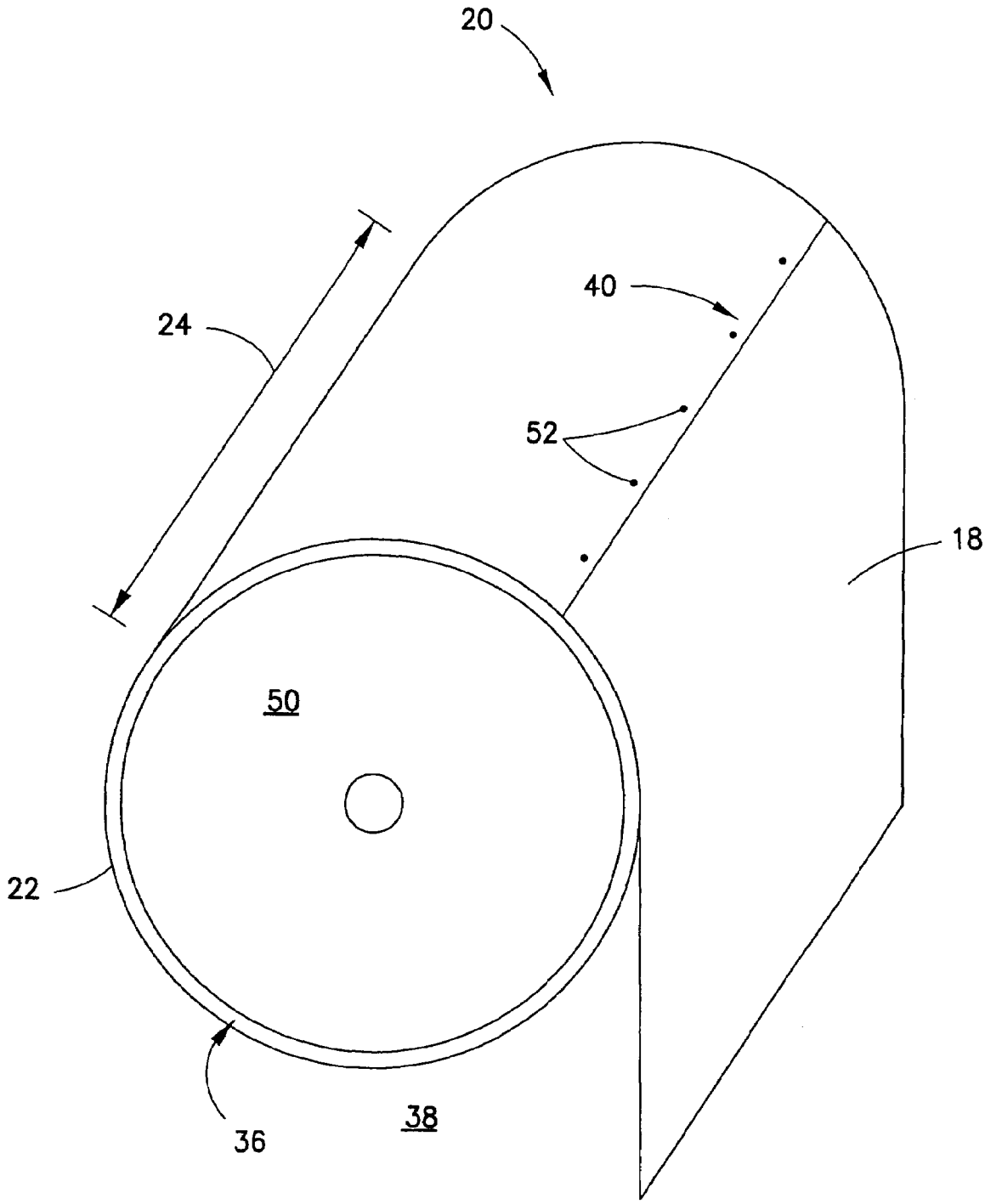
FIG. 3 is a perspective view of an exemplary roller tube.

The surface feature 40 can include a flange 44 extending over at least a portion of the groove 42. The flange 44 can be malleable and thus deformed to fix a sheet material 18 inserted between the flange 44 and the groove 42. Alternatively, the flange 44 can be deformed (e.g., bent) along its entire length to retain the edge of the sheet material 18. The flange 44 can substantially close over the groove 42. The flange 44 can extend the length 24 from the first end 26 to the second end 28. In another exemplary embodiment, the flange 44 can be formed intermittently along the exterior 38, such that the flange 44 does not cover the entire groove 42 along the length 24. The width 46 of the flange 44 can be varied depending on the service requirements of the roller tube 20. The flange width 46 can be greater than the thickness 34 of the tube wall 32. The flange 44 can be pressed against the sheet material 18 along the length 24 at predetermined intervals. In an exemplary embodiment, the predetermined intervals can be from about 3 inches to about 5 inches. The flange 44 can be staked or hammered at the predetermined interval in order to deform the flange 44 onto the sheet material 18, as illustrated at stake points 52 in FIG. 3.

Since the surface feature 40 does not create a protrusion in the interior, a drive motor can be mounted in the interior 36 of the tube body 22 with a snug fit. The drive motor housing can be formed in a substantially circular shape that matches with the interior 36 of the tube body 22. There is no need to modify the drive motor for installation into the exemplary roller tube 20.

Figure 4:
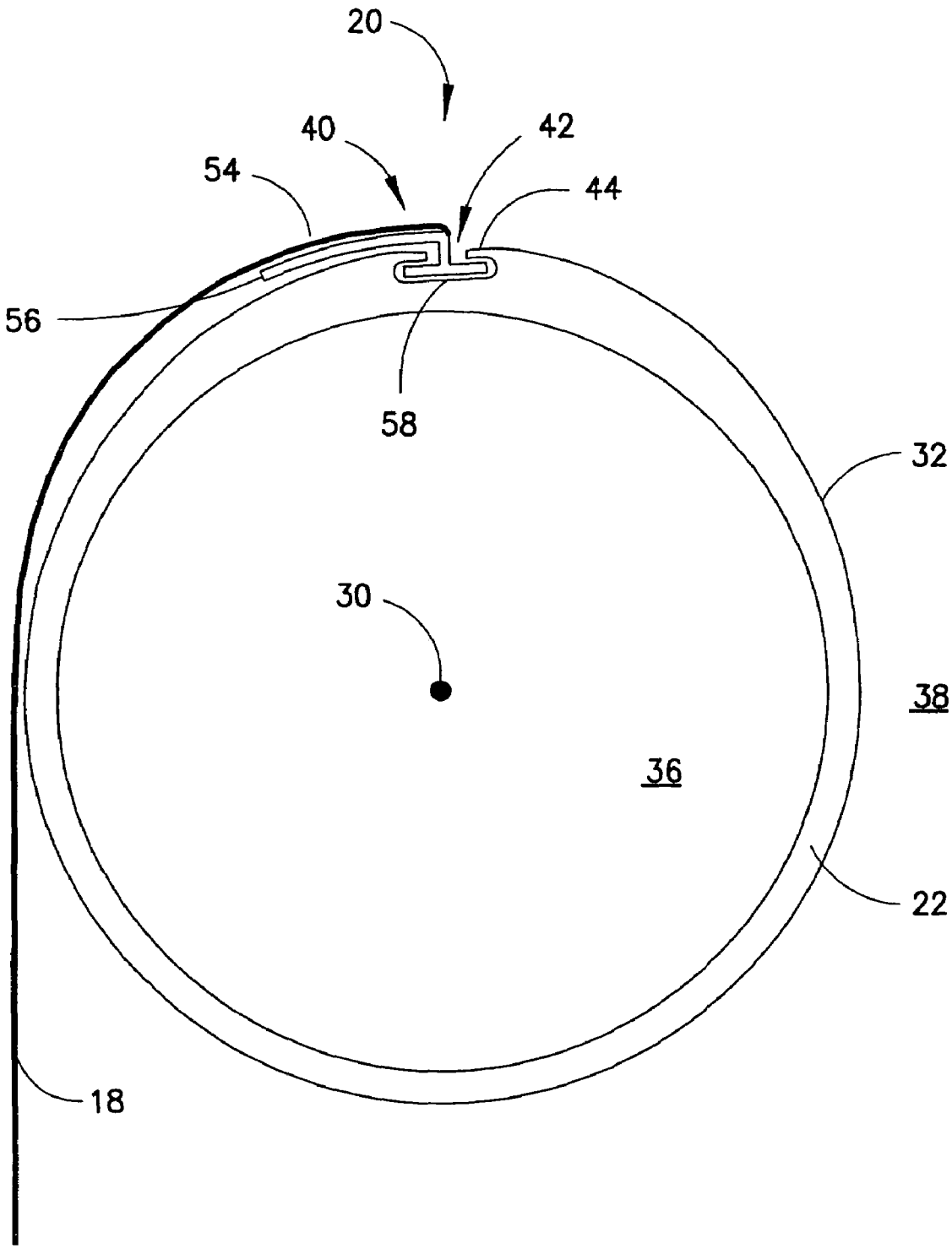
FIG. 4 is a side cross-sectional view of an exemplary roller tube with attachment insert.

Referring to FIG. 4 an exemplary roller tube is illustrated in a cross-sectional view. The roller tube 20 in this exemplary embodiment includes many of the features of the previously disclosed embodiments. The roller tube 20 includes a tube body 22 defining the interior 36 and exterior 38. The tube body 22 includes the tube wall 32 defining the surface feature 40. The surface feature 40 can include at least one flange 44. In the exemplary embodiment illustrated, the surface feature 40 includes two flanges 44 proximate the groove 42. The flanges 44 can extend the length 24 of the tube body 22. In another exemplary embodiment, the flanges 44 can be formed intermittently along the length 24.

The groove 42 can be configured to receive an attachment insert 54 that slides into the groove 42. The attachment insert 54 can be fixed in the surface feature 40 after being inserted. The attachment insert 54 is configured to couple to the sheet material 18 and align the sheet material 18 with the axis 30 of the roller tube 20 such that the sheet material 18 can wind and unwind around the roller tube 20 evenly and without binding. The attachment insert 54 can be configured for insertion into the groove 42 from one of the ends 26, 28 of the tube body 22 and slid axially into a secured position aligning the sheet material 18 with the roller tube 20. The flanges 44 prevent the attachment insert 54 from disconnecting from the groove 42. After insertion, the attachment insert 54 is secured by the sheet material 18 as the sheet material is wound around the roller tube 20. In an optional exemplary embodiment, the flange 44 can be malleable and deformed into a position of interference with the attachment insert 54, thereby binding the attachment insert 54 in the groove 42.

The sheet material can be secured to the attachment insert 54 by means of fasteners, such as sewing the sheet material 18 to the attachment insert 54 and/or by welding (e.g., ultrasonic or hot air weld) the sheet material 18 to the attachment insert 54. The attachment insert 54 allows for alignment of the sheet material 18 to the roller tube 20 with great precision and with minimal assembly time. The sheet material 18 and attachment insert 54 can be coupled together with exact alignment separately before being coupled to the roller tube 20. The sheet material 18 and attachment insert 54 assembly can be easily attached to the roller tube 20 by sliding the attachment insert 54 into the groove 42 from one of the first or second ends 26, 28.

The attachment insert 54 includes an attachment portion 56 configured to attach to the sheet material 18. The attachment portion 56 can be located proximate the exterior 38 of the roller tube body 22. The attachment portion 56 is coupled to an insert portion 58 of the attachment insert 54. The insert portion 58 can be configured with a shape for insertion in the surface feature 40 and coupled therein. The insert portion 58 can have a profile that is shaped similar to the groove 42 and held into the groove 42 by the flanges 44. In an exemplary embodiment, the attachment insert 54 comprises a polyvinyl chloride material or other similar material having properties allowing for the attachment insert 54 to bind to the sheet material 18 as well as securely insert into the surface feature 40. It should be appreciated that the attachment insert 54 could alternatively be fabricated from any other suitable material, such as other plastics, aluminum, or the like.

The exemplary roller tube disclosed herein provides the advantage of fixing a sheet material (solar screen material or the like) to the exterior of the roller tube body in a substantially perpendicular fashion without creating a protrusion in the interior of the roller tube body. The exemplary roller tube also allows for the material to accurately and quickly attach to the roller tube body with the correct alignment. With the exemplary roller tube, a drive motor can be mounted to the interior of the roller tube body without being modified. A tight engaging fit can be achieved between the drive motor and the interior of the roller tube body because the surface feature does not require any protrusions into the interior.

While the present invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A roller tube comprising:

a body having a tube wall defining an interior and an exterior, said body including a first end and a second end opposite said first end; and a surface feature including a flange extending from a groove formed in said tube wall proximate said exterior, said surface feature configured to receive and fix sheet material to said tube wall;

said flange being deformable and configured to substantially close over said groove to secure sheet material to said tube wall exterior;

wherein said surface feature allows a generally circular profile to be maintained in said tube wall proximate said interior.

2. The roller tube of claim 1 wherein said surface feature is malleable and configured to attach sheet material in a fixed position orthogonal to an axis of rotation of said body.

3. The roller tube of claim 1 wherein said surface feature extends between said first end and said second end.

4. The roller tube of claim 1 in combination with a drive motor having a housing, wherein said tube wall interior is configured to receive the drive motor housing internally mounted in said tube wall interior.

5. The combination of claim 4 wherein said drive motor comprises a substantially circular housing exterior.

6. The combination of claim 4 wherein said tube wall includes an interior having a substantially circular diameter and being configured to receive said drive motor in the absence of modification to the drive motor exterior shape.

7. The roller tube of claim 1 wherein said surface feature is configured with the absence of protrusions at the tube wall interior.

8. The roller tube of claim 1 in combination with a sheet material affixed thereto, wherein said flange is pressed against said sheet material at predetermined intervals along the tube wall for securing said sheet material to said roller tube.

9. The roller tube of claim 1 in combination with a sheet material affixed thereto, wherein said sheet material comprises a solar screen.

10. A method of securing a sheet material to a roller tube comprising:

forming a roller tube body from a tube wall defining an interior and an exterior, said roller tube body including a first end and a second end;

forming a groove and flange in said tube wall proximate said exterior with the absence of protrusions in said interior of said tube wall;

inserting a sheet material into said groove; and deforming said flange over said groove to fix said sheet material to said roller tube.

11. The method of claim 10 wherein said flange is integrally formed from said tube wall and extends from said tube wall.

12. The method of claim 10 further comprising:

receiving a drive motor in said interior in the absence of modification to said drive motor housing.

13. The method of claim 10 further comprising: pressing said flange against said sheet material at predetermined intervals along said tube wall to secure said sheet material.

14. The method of claim 13 wherein said predetermined interval comprises from about 3 inches to about 5 inches.

15. The method of claim 10 further comprising:

winding said sheet material around said roller tube at least one and a half revolutions to secure said sheet material to said roller tube.

16. The method of claim 10 wherein said interior of said tube body is substantially circular in shape.

17. The method of claim 10 wherein said sheet material comprises a solar screen.

18. A roller tube comprising:

a body having a tube wall defining an interior and an exterior, said body including a first end and a second end opposite said first end; and a surface feature formed in said tube wall proximate said exterior, said surface feature configured to receive an attachment insert for coupling sheet material to said tube wall, wherein;

said surface feature includes at least one flange extending from a groove formed in said tube wall;

said at least one flange is deformable and configured to substantially close over said groove to secure said attachment insert to said tube wall exterior; and said surface feature allows a generally circular profile to be maintained in said tube wall proximate said interior.

19. The roller tube of claim 18 wherein said surface feature is configured to attach sheet material in a fixed position orthogonal to an axis of rotation of said body.

20. The roller tube of claim 18 wherein said surface feature extends between said first end and said second end.

21. The roller tube of claim 18 wherein said tube wall interior is configured to receive a drive motor housing internally mounted in said tube wall interior.

22. The roller tube of claim 21 wherein said drive motor comprises a substantially circular housing exterior.

23. The roller tube of claim 21 wherein said tube wall includes an interior having a substantially circular diameter and being configured to receive said drive motor in the absence of modification to the drive motor exterior shape.

24. The roller tube of claim 18 wherein said surface feature is configured with the absence of protrusions at the tube wall interior.

25. The roller tube of claim 18 wherein said at least one flange is configured to be pressed against said attachment insert at predetermined intervals along the tube wall.

26. The roller tube of claim 18 wherein said attachment insert is coupled to said sheet material by one of welding and sewing.

27. A roller tube comprising:

a body having a tube wall defining an interior and an exterior, said body including a first end and a second end opposite said first end; and a surface feature formed in said tube wall proximate said exterior, said surface feature configured to receive an attachment insert for sheet material;

wherein:

said surface feature comprises a groove running longitudinally along the exterior of said body and adapted to slidably receive said attachment insert therein;

the tube wall varies in thickness and has a relatively thick section to accommodate said groove being formed therein; and the exterior of said body is eccentric with respect to the interior of said body due to the varying thickness of the tube wall.

28. The roller tube of claim 27 wherein the interior of said body has a circular profile.

29. The roller tube of claim 28 wherein said circular profile is adapted to snugly receive a motor having a substantially circular outer shape.

30. The roller tube of claim 27 wherein said groove extends from said first end to said second end.

* * * * *